United States Patent [19]

Smith

[11] Patent Number: 4,851,640

[45] Date of Patent: Jul. 25, 1989

[54] FROST PLUG HEATER

[75] Inventor: Edward L. Smith, Brooklyn Park, Minn.

[73] Assignee: The Budd Company, Troy, Mich.

[21] Appl. No.: 120,233

[22] Filed: Nov. 13, 1987

Related U.S. Application Data

[63] Continuation of Ser. No. 920,718, Oct. 17, 1986, abandoned.

[51] Int. Cl.[4] ..... H05B 3/02; H05B 3/82; F02N 17/06

[52] U.S. Cl. ..... 219/208; 123/142.5 E; 219/318; 219/336; 219/536; 220/251

[58] Field of Search ..... 220/243, 248–251; 219/208, 318, 335, 336, 536, 523; 123/142.5 R, 142.5 E

[56] References Cited

U.S. PATENT DOCUMENTS

| | | | |
|---|---|---|---|
| 832,093 | 10/1906 | Stoltfus | 220/251 X |
| 1,999,704 | 4/1935 | Rigney | 220/251 |
| 2,242,503 | 5/1941 | Baule . | |
| 2,401,847 | 6/1946 | Urbant et al. . | |
| 2,620,429 | 12/1952 | Boger et al. . | |
| 2,783,352 | 2/1957 | McKay . | |
| 2,824,945 | 2/1958 | Derumaux . | |
| 2,987,283 | 6/1961 | Bleckmann . | |
| 3,084,827 | 4/1963 | Dyer | 220/251 |
| 3,143,634 | 8/1964 | Windsor | 219/208 |
| 3,148,268 | 9/1964 | Heinbuch | 219/205 |
| 3,157,773 | 11/1964 | Pickard | 219/205 |
| 3,165,621 | 1/1965 | Windsor | 219/208 |
| 3,209,123 | 9/1965 | Windsor | 219/208 |
| 3,211,888 | 10/1965 | Windsor | 219/208 |
| 3,229,069 | 1/1966 | Kerl et al. | 219/208 |
| 3,280,298 | 10/1966 | Klancke et al. | 219/208 |
| 3,456,094 | 7/1969 | Klancke et al. | 219/208 |
| 3,587,548 | 6/1971 | Wernicke | 219/208 X |
| 3,646,314 | 2/1972 | Windsor | 219/208 |
| 3,766,356 | 10/1973 | Feldmann | 219/208 |
| 4,175,229 | 11/1979 | Brinkhof et al. | 219/208 |
| 4,242,564 | 12/1980 | Kendall | 219/208 |
| 4,465,039 | 8/1984 | Snelgrove et al. | 219/208 X |
| 4,480,604 | 11/1984 | Chang et al. | 219/208 X |
| 4,485,771 | 12/1984 | Brinkhof et al. | 123/142.5 E |

FOREIGN PATENT DOCUMENTS

| | | | |
|---|---|---|---|
| 512017 | 4/1955 | Canada . | |
| 850767 | 9/1970 | Canada | 219/208 |

*Primary Examiner*—Anthony Bartis

*Attorney, Agent, or Firm*—Harness, Dickey & Pierce

[57] ABSTRACT

The clamping mechanism for securing in place an electric heating element insertable through a frost plug aperture into the coolant passage in the blocks of a water cooled internal combustion engine includes a screw having a head located on the outside of a removable body member carrying the heating element, which body member is adapted to be inserted into the apertures to sealingly close it against leakage. The inner end of the screw extends freely through an opening formed in a bight portion connecting a pair of opposed side walls of a rigid yoke having a length greater than the largest dimension of the aperture and adapted to engage the inner surface of the block around the aperture and is threaded into a nut loosely captivated within the yoke by the bight portion, side walls and detents extending inwardly from the side walls and overlying the bight portion. The yoke opening is so sized and the detents are so arranged that the rigid yoke may be tilted about the screw to enter the block through the aperture. The screw head is shaped to be engageable by a socket driven by a power tool, such as an electric or pneumatic screw driver, for rotating the screw to tighten the clamping means during assembly of the immersion heating element into the engine block.

7 Claims, 1 Drawing Sheet

FROST PLUG HEATER

This is a continuation application of U.S. patent application Ser. No. 920,718, filed Oct. 17, 1986 entitled "Frost Plug Heater", now abandoned.

TECHNICAL FIELD

This invention relates to electric immersion heaters and, more particularly, to heaters which are particularly useful for use in connection with water cooled internal combustion engines.

BACKGROUND

In the construction of water cooled internal combustion engines, it is common practice to cast the cylinder block and its water jacket in one piece and to provide in the walls of the water jacket suitable apertures to permit the removal of the sand at the termination of the casting operation. When the engines are finally assembled, these openings are then closed with suitable dished plates or plugs. Advantage has been taken of the presence of these apertures in the water jacket by removing one of those plugs and mounting an electric heating device in place thereof. In general, these electrical heating devices take the form of a disc shaped body member with a heating element that extends within the water jacket and has terminals accessible at the outside of the disc, with the terminals being connected to a suitable energy source for the purpose of energizing the heater to keep the engine temperature heated to an acceptable level during cold weather.

A variety of so-called frost plug heaters are known in the art. A representative, although not exhaustive, list of these devices in the patent literature include:

| | U.S. Pat. No. | Inventor | Issue Date |
|---|---|---|---|
| | 2,401,847 | Urbant et al | 06/11/46 |
| | 2,783,352 | McKay | 02/26/57 |
| | 2,824,945 | Derumaux | 02/25/58 |
| | 3,143,634 | Windsor | 08/04/64 |
| | 3,148,268 | Heinbuch | 09/08/64 |
| | 3,157,773 | Pickard | 11/17/64 |
| | 3,165,621 | Windsor | 01/12/65 |
| | 3,209,123 | Windsor | 09/28/65 |
| | 3,211,888 | Windsor | 10/12/65 |
| | 3,229,069 | Kerl et al | 01/11/66 |
| | 3,280,298 | Klancke et al | 10/18/66 |
| | 3,456,094 | Klancke et al | 07/15/69 |
| | 3,587,548 | Wernicke | 06/28/71 |
| | 3,646,314 | Windsor | 02/29/72 |
| | 4,175,229 | Brinkhof et al | 11/20/79 |
| | 4,242,564 | Kendall | 12/30/80 |
| | 4,465,039 | Snelgrove et al | 08/14/84 |
| | 4,480,604 | Chang et al | 11/06/84 |
| | 4,485,771 | Brinkhof et al | 12/04/84 |
| Canadian | 512,017 | Beaton et al | 04/19/55 |
| Canadian | 850,767 | Ehgoetz | 09/01/70 |

Insofar as the present invention is concerned, it is believed that U.S. Pat. No. 3,646,314; U.S. Pat. No. 4,175,229; and Canadian Pat. No. 850,767 are the most pertinent. Each of the constructions shown in these patents have their various drawbacks. For example, the construction shown in the '314 patent is designed with the head of the screw on the interior side of the disc. As a result, much of the screw extends outwardly when the device is in place. Consequently, a low profile of the device is not obtainable, since the screw juts out a considerable distance from the disc. This has certain disadvantages not only from an aesthetic viewpoint but also in manufacturing. For example, this design is somewhat cumbersome to install especially in an automated assembly line. Since the screwhead is on the inside in this prior approach, it is not possible to be engaged by an automated tool to turn the screw and thus tighten the assembly.

The Canadian '767 patent has drawbacks because this approach generally requires that the disc have a very thin wall, typically on the order of 1/16 inch thick or less. If a much thicker disc is used then there is not a sufficient amount of tilt allowed to permit the clamping member to enter through the bore in the engine block. The use of such a thin walled disc is disadvantageous by the inability to provide a rugged device construction with cost effective materials and manufacturing processes. It will also be noted that in this prior art approach that an oversized aperture is provided through which the screw extends and that the screw is threaded right into the clamping member. Thus, in order to get the clamping member through the bore in the engine block it is necessary to cant the screw a considerable distance. Since the aperture in the disc is relatively large, the chances of leakage are increased.

The '229 U.S. patent discloses a relatively complex structure in that it relies upon two separate wing shaped clamping members, a spring, and a nut design which may become disengaged from the screw. As a result, this approach tends to be relatively costly to manufacture from both a materials and labor standpoint.

SUMMARY OF THE INVENTION

A frost plug heater is provided pursuant to the present invention that provides advantages both from an initial manufacturing standpoint as well as from the viewpoint of the ultimate assembly process for mounting the device onto the engine block and its removal therefrom if it becomes necessary.

Pursuant to the present invention, the clamping means used in the device includes a screw that has a head configured to be received by a suitable socket or driver in an automatic rotating tool for rotating the screw. The screw passes through a bore in the body member such that the head is located on the outside thereof. The inner end of the screw extends through an aperture in a yoke and a nut is threadably secured to the screw. Captive means are provided for preventing rotation of the nut during assembly of the heater which can be performed easily with the use of an automatic tool for engaging the screw head to rotate same and clamp the yoke against the inner wall of the engine block. In the preferred embodiment, the disc shaped body member is relatively thick and provides a rugged structure. The yoke includes two parallel side walls connected by a bight portion and detents extending from the side walls over the bight portion to maintain the nut axially within the confines of the yoke. The detents are spaced a sufficient distance from the bight to permit the yoke to be tilted about the screw at a sufficient angle to enable it to enter the engine block aperture during assembly.

BRIEF DESCRIPTION OF THE DRAWINGS

The various advantages of the present invention will become apparent to those skilled in the art upon a study of the following specification and by reference to the drawings in which.

DESCRIPTION OF THE PREFERRED EMBODIMENT

Figure 1:
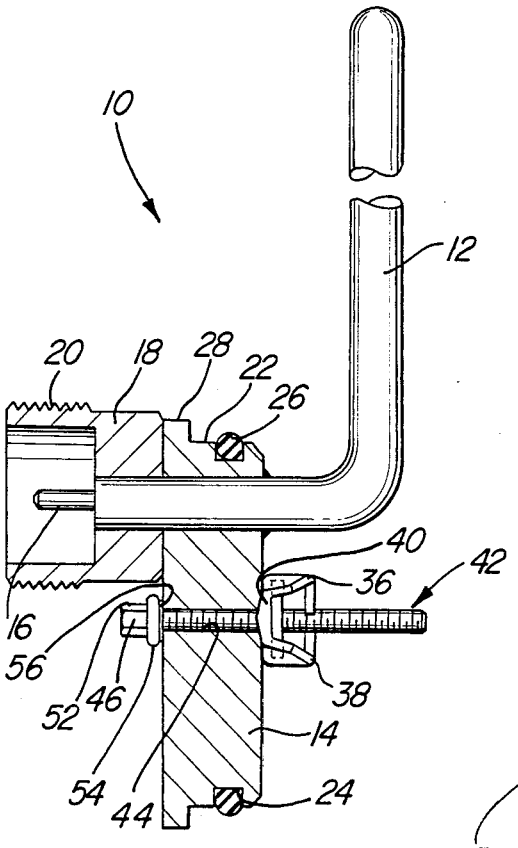
FIG. 1 is a cross sectional view of a frost plug heater made in accordance with the teachings of the present invention.

Referring now to the drawings, the heater 10 of the preferred embodiment includes an electric heating element 12 connected to a disc shaped body member 14. The heating element 12 can be of any suitable type such as the well known tubular sheeted wire type commonly used in immersion heaters of the general type to which the present invention pertains. The ends of the heater 12 are operably connected to a pair of terminals (one of which is shown in FIG. 1 at 16) which are adapted to mate with female sockets in an electrical plug (not shown) on a wire or cord whose opposite end is adapted to be plugged into a suitable energy source such as a typical household 115 volt A/C source. Preferably, the electrical terminals 16 are mounted within the confines of a structural tubular member 18 provided with threads 20 on its peripheral portion for receiving internal threads on a mating annular member (not shown) on the electrical plug. Such a construction provides a rugged and reliable interconnection to the electrical source.

Preferably, the body member 14 is constructed of a solid material having a thickness in excess of ⅛ inch to provide the heater with good structural integrity. In the preferred embodiment, the member 14 is machined from a free machining grade of steel as necessary. A groove 24 is provided in the peripheral wall 22 of body member 14 to receive an O ring 26. The flange 28 with the extreme diameter for the periphery of body member 14 is slightly larger than the bore 30 in the engine block 32 as can be seen most clearly in FIGS. 3 and 4. The reduced diameter section 22 of body member 24 is, of course, slightly smaller than the diameter of bore 30.

A clamping means is provided for clamping the heater 10 into the engine block 32. To this end, a yoke member 34 is provided that has a length which is slightly larger than the diameter of engine block bore 30. Yoke 34 includes a pair of generally parallel side walls 36 and 38 which are connected together by bight portion 40. A screw generally designated by the numeral 42 extends through a bore 44 in body member 14. The outer end of screw 42 includes an enlarged head 46 configured to be received by a socket in an automatic rotating tool such as a pneumatic or electric powered screwdriver. The tool 48 and socket 50 are shown in phantom lines in FIG. 4 and will be discussed in more detail later herein. The head configuration may take various forms such as hex washer, recessed hex, slotted or cross (Phillips) round or pan. In the preferred embodiment, the head construction is of the hex washer type which includes a hexagonal male portion 52 and a flat flange portion 54. In the specific embodiment illustrated in the drawings, the screw is approximately 1.50 inch long and about 0.190 inch in diameter. The bore 44 is approximately 0.20 inch in diameter thereby providing a relatively close but sliding fit for the screw 42. As a result, the screw 42 can slide axially within bore 44 but a very limited amount of tilt (less than ±3 degrees) is permitted between the screw axis and the bore axis. A sealing ring 56 is provided on the interior portion of head flange 54. A sealing washer may be used with some screwhead styles.

Figure 5:
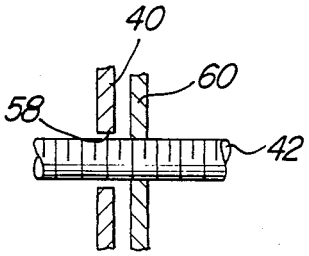
FIG. 5 is a fragmented cross sectional view illustrating the dimensional relationship between various members used to clamp the heater to the engine block.

The interior end of screw 42 passes through an aperture 58 in the yoke bight portion 40 as can be seen most clearly in FIG. 5. The yoke aperture 58 is larger than the diameter of screw 42 and thereby provides a sliding fit and permits a certain amount of relative tilting between the screw axis and the yoke 34 as will appear. It is preferred to have the diameter of the yoke aperture 58 to be larger than the bore 44 in the body member because the smaller bore diameter restricts the space around screw 42 through which cooling fluid can possibly leak through the heater while the larger yoke aperture diameter provides a sufficient degree of tilt to yoke 34 to enable the heater to be assembled properly. Screw 42 is threadably coupled to a captive nut 60. The inner end of screw 44 is upset, i.e., one or more thread deformed, so that the nut cannot be removed from the screw 42 and thereby accidentally fall within the confines of the engine block.

Figure 2:
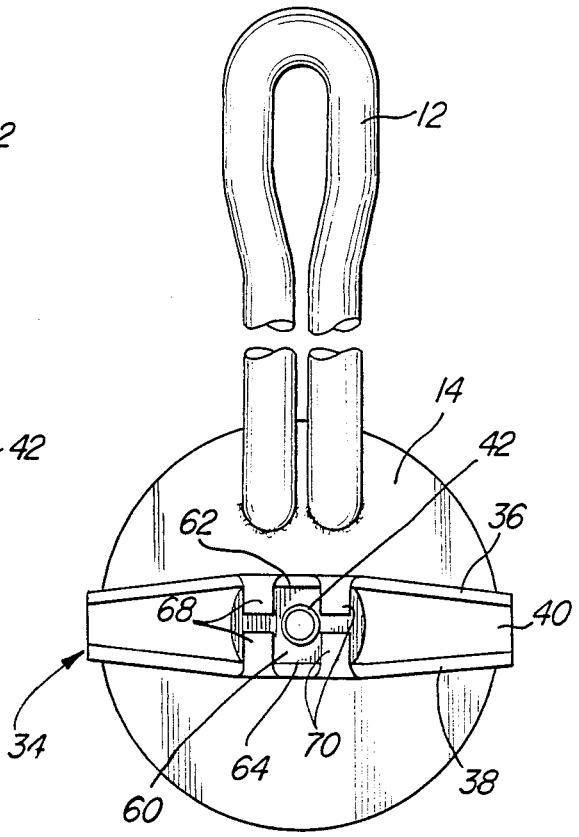
FIG. 2 is a plan view of the heater viewed from the interior side thereof.
Figure 3:
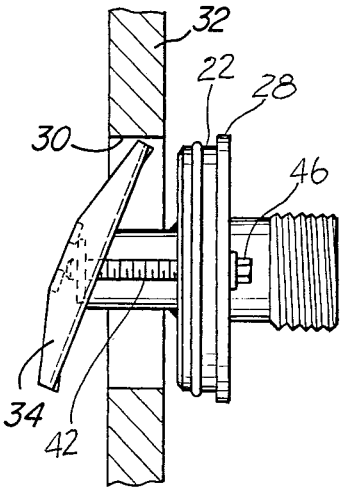
FIG. 3 is a sectional view showing the heater of the preferred embodiment during an intermediate assembly step.

Means are provided for preventing rotation of the nut during assembly of the heater 10 by the automated tool 48. As can be seen most clearly in FIG. 2, nut 60 includes a pair of sides 62 and 64 which are dimensioned to be slightly smaller than the distance between the side walls 36 and 38 of yoke 34. In such manner, abutment of the nut side against the yoke walls will prevent rotation of the nut. Two pair of detents 68 and 70 extend from the inner most portions of the yoke side walls and extend over the bight portion 40 to maintain the nut 60 axially within the confines of the yoke. The detents 68 and 70 are spaced a sufficient distance from the bight portion 40 to permit the yoke 34 to be tilted relative to the axis of screw 42 at a sufficient angle to enable the yoke 34 to enter the engine block 30 as shown in FIG. 3. In the preferred embodiment, detents 68 and 70 are spaced about 0.25 inch from bight 40. One pair of detents, diagonally opposed, can be used instead of two pair.

Figure 4:
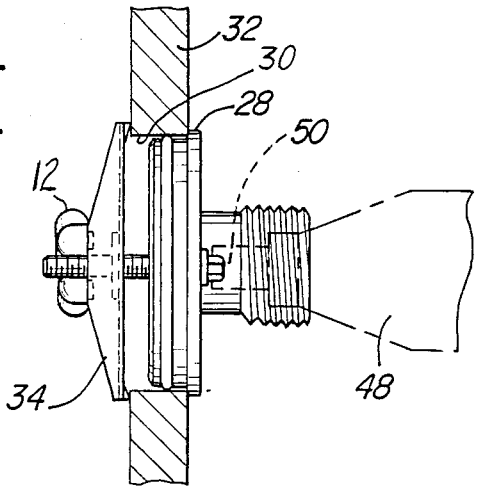
FIG. 4 is a cross sectional view showing the heater of FIG. 3 assembled onto an engine block.

It is a feature of this invention that the heater 10 can be assembled quite easily using automated assembly equipment. During assembly, the screw 42 is preferably turned counterclockwise to back it off as much as possible to the limit provided by the upset at the end of the threaded portion thereof. Then the user can manipulate the heating element 12 and the yoke 34 through the engine block bore 30 as shown in FIG. 3. Continued movement of the heating element by the user towards the engine block 32 brings the periphery of body member 14 into proper position with the O-ring 26 sealing against the bore 30 and the extreme flange 28 abutted against the outer wall of the engine block 32 as can be seen in FIG. 4. Then, all that needs to be done is for the user to engage the screwhead 46 with the machine tool socket 50 and energize the tool 48 to rotate the head clockwise. This clockwise rotation of head 50 causes the nut 60 to move towards head 60 thereby straightening the yoke 34 and eventually bringing it into a clamping position against the inner wall of the engine block 32 as shown in FIG. 4. During this assembly, the nut is captive within the yoke 34 as described above due to the configuration of the nut sides relative to the side walls of the yoke the provision of the detents 68 and 70. By reversing this procedure, the heater 10 may be removed.

From the foregoing, those skilled in the art can appreciate the present invention provides some significant advantages over many of the known constructions. Since the screw head 50 is located on the outer side of the disc body 14, the head 50 can be easily grasped by the automated machine tool thereby making assembly relatively quick. In addition, this construction provides a low profile since the large length of the screw is extending interiorly of the engine block after assembly and does not jut out as in some of the prior art approaches. The heater of this invention also can be manufactured using relatively straight-forward techniques and at relatively low cost to provide an extremely rugged and reliable device.

It should be understood that while this invention has been described in connection with one particular example, that the present invention is not so limited. For example, the device has a wide variety of applications and can be used to heat a wide variety of media held in a container, not just liquid coolant held in an engine block. This design could be applied to any need for installing a plug into a hole where the back or interior side is not accessible. Those skilled in the art will come to appreciate that other modifications and advantages can be obtained after a study of the specification, drawings and following claims.

What is claimed is:

1. In an electric immersion heater for heating liquid in a container having an aperture in a wall thereof, said heater including a disc shaped body member adapted to close the aperture and having an electric immersion heater element mounted thereto, the body member having means adapted to engage the outer surface of the container around the aperture, as well as clamping means including a rigid yoke having a length longer than the longest dimension of the aperture and being adapted to be engageable with the inner surface of the container adjacent the aperture for clamping the body member to the container so that it closes the aperture and the heater element extends through the aperture into the container, the improvement wherein the clamping means comprises a screw having a head, said head being configured to be received by a conventional socket in an automatic rotating tool, the screw passing through a bore in the body member such that the head is located on the outside thereof, the inner end of the screw extending loosely through an opening in the yoke of the clamping means, the opening having a larger diameter that the diameter of the screw, a nut threadably secured to the screw between the yoke and the inner end of the screw, said yoke cooperating with the nut for preventing rotation of the nut during rotation of the screw during assembly, and wherein said yoke includes two opposed side walls connected by a bight portion, the yoke further including detent means extending from at least one of said side walls over the bight portion, said nut being loosely capitavitively positioned between said side walls, bight portion and detent means thereby maintaining the nut within the confines of the yoke, said detent means being spaced a sufficient distance from the bight portion and nut, and detent means being so arranged with respect to the inner end of the screw, and said yoke opening being of such size to permit the yoke to be tilted about the screw to enter the container aperture during assembly, with the head configuration and outside location facilitating easy assembly by an operator using a rotating tool to engage the head for rotating the screw to tighten the clamping means.

2. The improvement of claim 1 wherein the nut has opposite sides thereof dimensioned to be slightly smaller than the distance between the side walls of the yoke whereby abutment of the nut sides against the yoke walls prevents rotation of the nut.

3. The improvement of claim 2 wherein the body member bore is sufficiently large to permit the screw to slide therein.

4. The improvement of claim 3 wherein the diameter of the yoke opening is greater than that of the bore in the body member.

5. The improvement of claim 4 wherein said body member is an integral piece of metal having a thickness in excess of $\frac{1}{8}$ inch.

6. A frost plug heater for heating coolant contained in an engine block having an aperture therein, said heater comprising:

a solid metallic disc shaped body member having a thickness between major faces of at least 1/8 inch, the body member being adapted to close the engine block aperture and including a peripheral portion adapted to engage the outer surface of the engine block around the aperture said disc carrying a heating element, a bore extending through the major faces of said body member, a screw extending through the bore and having a head located on the outside of the body member adapted to be received by a socket in a rotating machine; a rigid yoke having an opening through which the inner end of the screw loosely extends and a length larger than the largest dimension of the aperture in the engine block and engageable with the interior surface of the engine block around the aperture, said yoke having a pair of opposed side walls connected by a bight portion, the yoke further including detent means extending from at least one of the yoke side walls over the bight portion, a nut threadably secured to the screw and loosely captivatively located within the confines of said yoke between said bight portion, detent means and side walls; said detent means being spaced a sufficient distance from the bight portion, said detent means being so arranged with respect to the inner end of the screw, and the opening in the yoke through which the screw extends being of such size to permit the yoke to be tilted about the screw to enter the engine block aperture during assembly while restricting the degree of maximum tilt of the yoke, with the nut sides being dimensioned to be slightly smaller than the distance between the side walls of the yoke whereby abutment of the nut sides against the yoke walls prevents rotation of the nut, and all of the dimensions of the head as viewed from the screw axis being smaller than the dimensions of the nut, and the head being smaller than the nut and being selected from the group of hex washer, recessed hex, cross round, slotted round, cross pan and slotted pan heads whereby the rotating machine socket can easily obtain access to the relatively small head.

7. The heater of claim 6 wherein the yoke includes an opening larger in diameter than the bore and wherein said detent means comprises a pair of detents located on opposite sides of the yoke opening.

* * * * *